US006298832B1

(12) United States Patent
Yamazoe et al.

(10) Patent No.: US 6,298,832 B1
(45) Date of Patent: Oct. 9, 2001

(54) FUEL INJECTION FEED DEVICE IN MOTORCYCLE FUEL INJECTION DEVICE

(75) Inventors: Hiroshi Yamazoe, Yokohama; Toshinobu Ueoka, Yokosuka, both of (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 09/455,716

(22) Filed: Dec. 7, 1999

(30) Foreign Application Priority Data

Dec. 11, 1998 (JP) ..... 10-375177

(51) Int. Cl.[7] ..... F02M 37/04
(52) U.S. Cl. ..... 123/514; 123/509; 123/510
(58) Field of Search ..... 123/509, 514, 123/463, 510, 516, 119.17

(56) References Cited

U.S. PATENT DOCUMENTS 5,103,793 * 4/1992 Riese et al. ..... 123/516
5,482,021 * 1/1996 Roche ..... 123/509
5,593,287 * 1/1997 Sadakata et al. ..... 417/366
5,762,048 * 6/1998 Yonekawa ..... 123/514
5,778,926 * 7/1998 Tanaka et al. ..... 137/508
5,873,349 * 2/1999 Tuckey et al. ..... 123/514
5,908,020 * 6/1999 Boutwell et al. ..... 123/541
5,979,485 * 11/1999 Tuckey et al. ..... 137/143
6,029,633 * 2/2000 Brandt ..... 123/509

* cited by examiner

*Primary Examiner*—Carl S. Miller
(74) *Attorney, Agent, or Firm*—B. Neil Sudol; Henry D. Coleman; William J. Sapone

(57) ABSTRACT

A fuel feed device in a motorcycle fuel injection device has excellent normal travel operation and hot restart property after high speed travel. A fuel case A has a fuel introduction chamber 4 to which a fuel introduction passage 6 is opened, a pump receiving chamber 5 for receiving a fuel pump P and a filter 9 on a longitudinal axis X—X and further has a fuel discharge passage 11 and a fuel discharge chamber 8 to which the fuel introduction passage 17 is opened. The longitudinal axis X—X is arranged substantially in a vertical direction. The fuel introduction chamber 4 of the fuel case A is disposed below a bottom surface T*a* of a fuel reservoir T.

5 Claims, 2 Drawing Sheets

FUEL INJECTION FEED DEVICE IN MOTORCYCLE FUEL INJECTION DEVICE

BACKGROUND OF THE INVENTION

Figure 1:
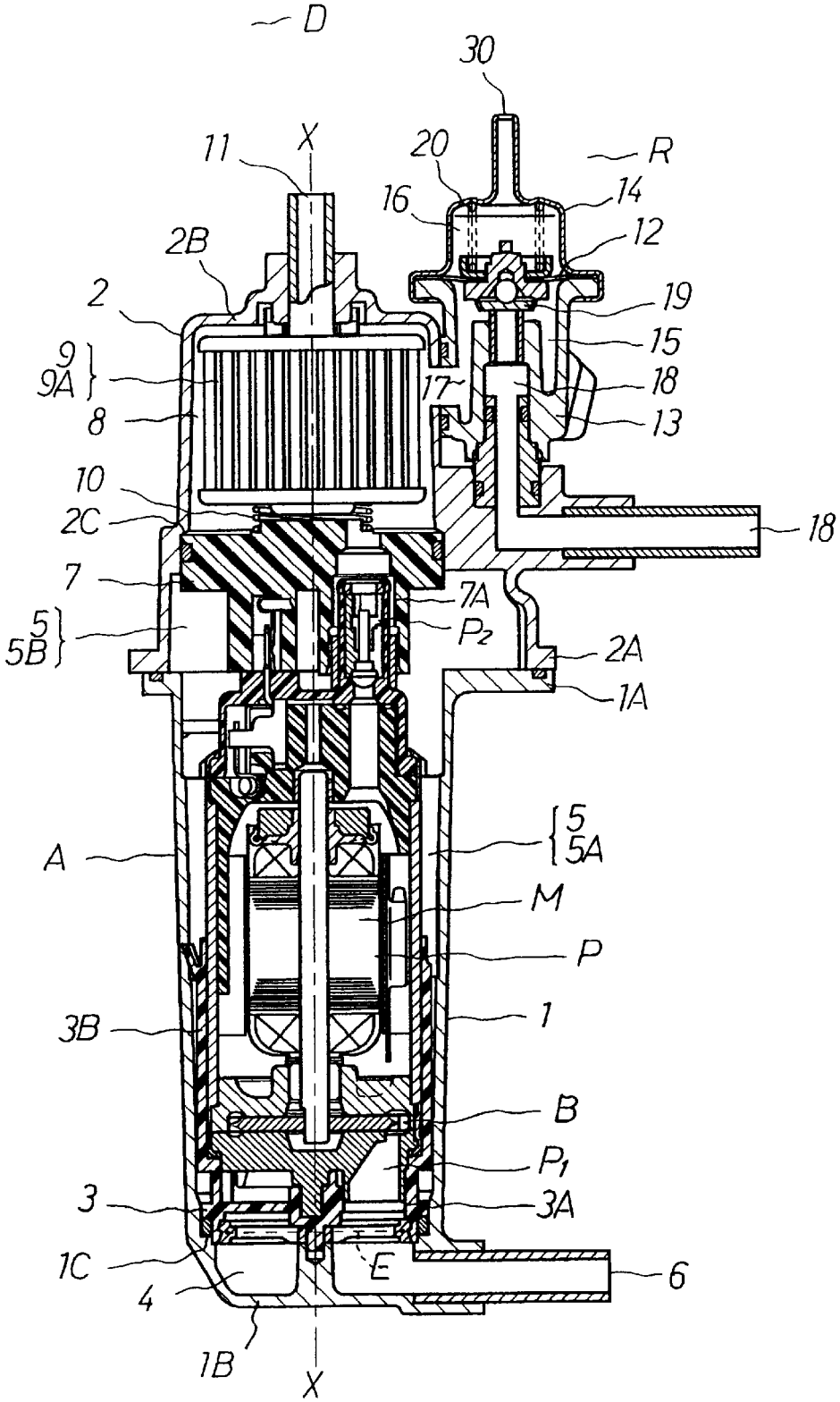

The present invention relates to a fuel injection device for pressurizing fuel within a fuel reservoir by a fuel pump and for injecting and feeding the pressurizing fuel to an engine through a fuel injection valve installed in a fuel distribution pipe, and more particularly to a fuel feed device in a motorcycle fuel injection device installed on a motorcycle.

In general, in a motorcycle, a fuel reservoir is disposed in an upper position and an engine is disposed in a lower position in a gravity direction, and a throttle body, a fuel distributor provided with a fuel injection valve, fuel pump, a fuel pressure control valve, a filter or the like are disposed in a space formed between the engine and the fuel reservoir. In view of the installability of the fuel feed device composed of the fuel pump, the fuel pressure control valve, the filter and the like to the motorcycle, the assembling property, and the compactness, the respective components of the fuel feed device are received and arranged within a single casing.

For example, the present applicant has Japanese Patent Application No. 352292/1997.

According to this publication, the interior of the single casing is divided into a fuel chamber and a return fuel chamber, the fuel chamber is connected to the fuel reservoir and an intake passage of a fuel pump disposed within the return fuel chamber is opened to the above-mentioned fuel chamber.

Then, a longitudinal axis of the casing provided with the fuel chamber and the return fuel chamber is arranged in the horizontal direction in the motorcycle.

The reason for the longitudinal axis of the casing being arranged in the horizontal direction as described above is that a plurality of throttle bodies each of which is connected to an associated intake pipe of a multi-cylinder engine are provided on the sides of the horizontal direction to thereby constitute a multiplicity of throttle bodies and the horizontal space formed along the multiplicity of throttle bodies may be utilized.

Then, the fuel within the fuel reservoir is caused to flow into the fuel chamber by the gravitational force and the fuel within the fuel chamber is sucked by the fuel pump. The fuel pressurized by the fuel pump is fed toward the fuel injection valve installed in the fuel distributor pipe.

The conventional fuel feed device for a motorcycle fuel injection device suffers from the following disadvantages.

(1) When the motorcycle travels in a normal way in a city area after traveling at a high speed for a long period of time, a smooth normal travel might be obstructed. This is because the engine temperature increases remarkably in the high speed travel and the elevated temperature increased an environmental temperature of the engine in the normal travel.

(2) In a hot restart in which the engine is stopped after it has been operated continuously for a long period of time and the engine is started again in a short time, the quick start of the engine would be obstructed. This is because the forcible cooling for the engine has not been performed so that the engine temperature increases remarkably to thereby increase remarkably the environmental temperature of the engine. A remarkable increase in environmental temperature is due to the fact that the engine is started under such condition.

As described above, when the environmental temperature of the engine increases remarkably, the fuel temperature reserved in the fuel reservoir increases remarkably, resulting in the generation of a large amount of bubble in the fuel chamber. The bubble is caused to move upwardly by its own floating force and stagnant in the upper portion of the fuel chamber.

On the other hand, referring to the fuel pump, this fuel pump is disposed along the longitudinal axis of the casing so that the fuel pump is arranged in the horizontal direction. As a result, the flow direction of the fuel flowing through the fuel pump is in the horizontal direction.

According to the present invention, the bubble generated in the fuel chamber is not sucked in a small amount continuously to the fuel pump. There is a fear that the bubble would be sucked immediately after a constant amount or more of the bubble stagnant in the upper portion of the fuel chamber is stagnated. It is difficult to feed stably the fuel toward the fuel injection valve. It is also difficult to feed a sufficient and necessary amount of fuel to start the engine.

SUMMARY OF THE INVENTION

In view of the foregoing defects, an object of the present invention is to provide a fuel feed device in a motorcycle fuel injection device, which may effectively discharge bubble generated in a fuel introduction chamber of a fuel case when an environmental temperature of an engine increases, whereby the drivability and the hot restart property of the engine may be enhanced.

In order to solve the above-described problems, according to the present invention, there is provided a fuel feed device in a motorcycle fuel injection device for pressuring fuel with in a fuel tank and for injecting and feeding the pressured fuel to an engine through a fuel injection valve mounted on a fuel distributor pipe, wherein:

a fuel flow chamber, a pump receiving chamber and a fuel discharge chamber are dividedly formed on a longitudinal axis X—X directing from one side to the other side, a fuel introduction passage is opened into said fuel introduction chamber;

an intake passage of a fuel pump disposed within said pump receiving chamber is opened into said fuel introduction chamber and at the same time a discharge passage of said fuel pump is opened into said fuel discharge chamber;

a fuel case in which a filter is disposed and a fuel discharge passage is opened into the filter and a fuel pressure control is provided in said fuel discharge chamber;

a fuel pressure control valve to which the fuel introduction passage is opened and to which a fuel return passage opened and closed by a valve moved in synchronism with the diaphragm is provided in a fuel chamber which is divided from a spring chamber and the fuel chamber by the diaphragm;

the longitudinal axis of said fuel case is arranged substantially in a vertical direction and said fuel introduction chamber is arranged below a bottom of a fuel reservoir; and said fuel introduction passage is in communication with said fuel reservoir and the fuel discharge passage is in communication with a fuel distributor pipe, the fuel introduction passage of said fuel pressure control valve is in communication with the fuel discharge chamber, wherein the fuel return passage is in communication with the fuel reservoir.

In addition to the first aspect of the present invention, according to a second aspect of the present invention, it is characterized that said return passage of said fuel pressure control valve is in communication with the fuel reservoir through the pump receiving chamber.

In addition to the first aspect of the present invention, according to a third second aspect of the present invention, the fuel introduction passage of said fuel pressure control valve is opened to a position above the fuel discharge chamber in the gravitational direction.

In addition to the first aspect of the present invention, according to a fourth aspect of the present invention, said fuel case is formed by a lower box provided with a lower bottom and an upper box provided with an upper bottom, and said fuel case is dividedly formed into said fuel introduction chamber, said pump chamber and said fuel discharge chamber by a first partitioning wall formed on a retainer stepped portion of the lower box and a second partitioning wall formed on a retainer stepped portion of the upper box.

In addition to the first aspect of the present invention, according to a fifth aspect of the present invention, a cylindrical portion extending upwardly along an inner side of the lower box is provided on said first partitioning wall, and said fuel pump is supported within said fuel case by said cylindrical portion.

According to the first aspect of the invention, as soon as the bubble is generated in the fuel introduction pressure, the bubble is absorbed from the fuel introduction chamber to the fuel pump and discharged to the fuel discharge chamber.

Then, the bubble that has been introduced into the fuel discharge chamber is likely to flow downstream toward the fuel discharge passage and yet it is subjected to the flow resistance by the filter. On the other hand, since the fuel introduction passage of the fuel pressure control valve and the fuel return passage are kept in communication condition when the valve is opened, the bubble is well discharged into the fuel reservoir through the fuel introduction passage and fuel return passage.

Also, according to the second aspect of the invention, the fuel in the fuel return passage of the fuel pressure control valve is discharged into the fuel reservoir once the fuel is introduced into the pump receiving chamber. Accordingly, the fuel pump disposed within the pump receiving chamber is effectively cooled.

According to the third aspect of the invention, the bubble that has been introduced into the discharge chamber is converged upwardly in the fuel discharge chamber due to its own floating force and is effectively discharged by the fuel introduction passage of the fuel pressure valve, which is opened at the position above the fuel discharge chamber.

According to the fourth aspect of the invention, the fuel introduction chamber, the pump chamber and the fuel discharge chamber may be very much easily formed in a divided manner by the first and second partitioning walls formed in the fuel case.

According to the fifth aspect of the invention, it is possible to the fuel pump within the fuel case by the cylindrical portion of the first partitioning wall without providing any special mounting means.

THE BRIEF DESCRIPTION OF THE DRAWINGS

Figure 2:
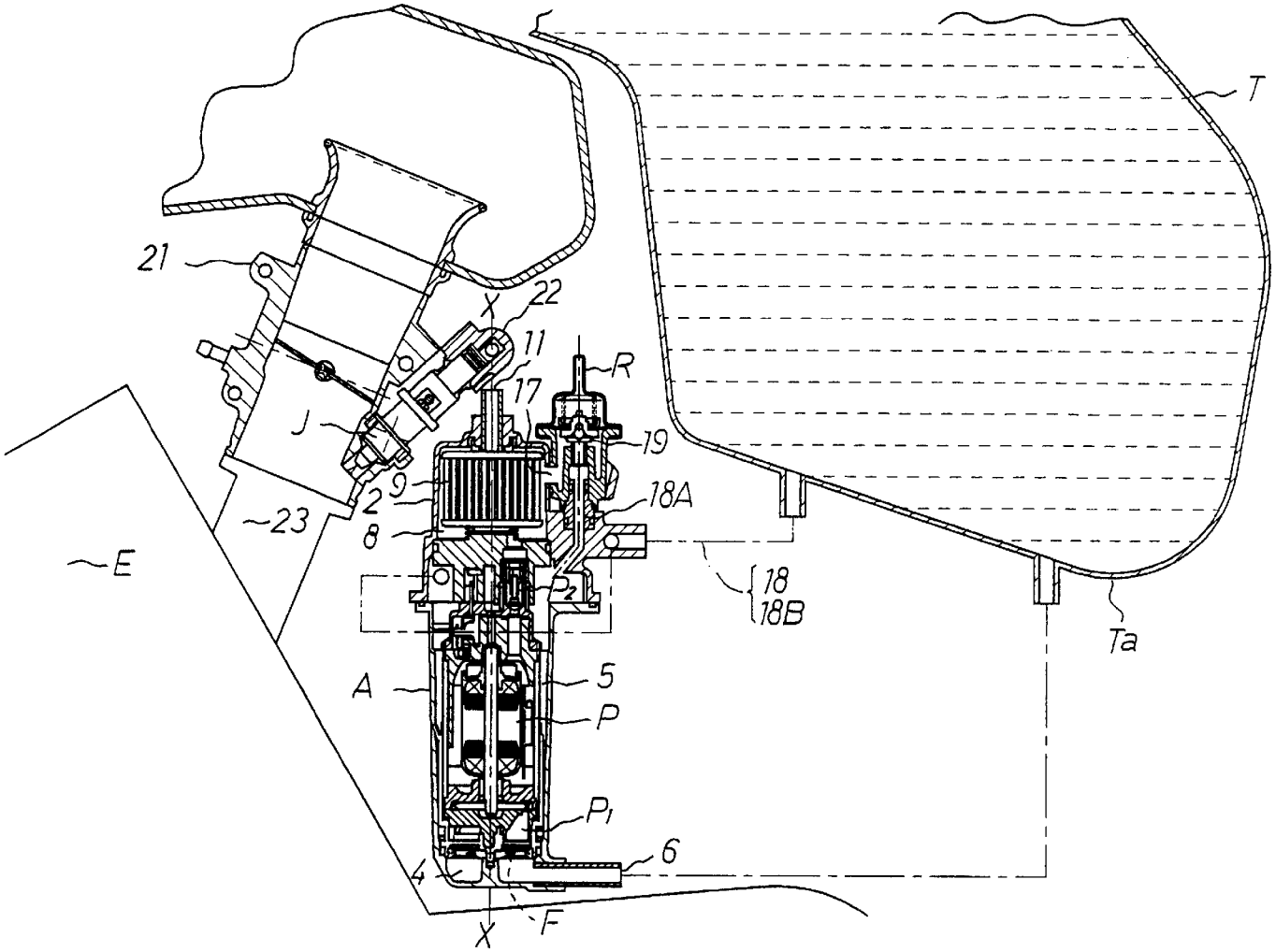

In the accompanying drawings:

FIG. 1 is a vertical sectional view showing a primary part of a fuel case provided with a fuel pump, a filter and a fuel pressure control valve of a fuel injection device in a motorcycle fuel injection device in accordance with an embodiment of the present invention; and FIG. 2 is a schematic longitudinal sectional view showing a state where the fuel case shown in FIG. 1 is mounted on the motorcycle.

PREFERRED EMBODIMENTS OF THE INVENTION

An embodiment of a fuel feed device in a motorcycle fuel injection device according to the present invention will now be described with reference to the FIG. 1 and FIG. 2.

A fuel case A is composed of a lower box 1 and an upper box 2. Namely, the lower box 1 forms a bottomed sleeve shape from an upper flanged portion 1A toward a lower bottom portion 1B, and the upper box 2 forms a bottomed sleeve shape from a lower flanged portion 2A toward an upper bottom portion 2B. Then, the above-described flanged portions 1A and 2A are brought into contact with each other and are fastened together by a fastening means such as screws (not shown) . Thus, a hermetic fuel case A is formed.

Reference numeral 3 denotes a first annular partitioning wall arranged and retained at a retainer stepped portion 1C formed in the vicinity of the lower bottom portion 1B of the lower box 1. By the partitioning wall, the lower box 1 is divided into a fuel introduction chamber 4 including the lower bottom portion 1B and a pump receiving chamber 5A including the flanged portion 1A. A first through-hole 3A for communicating the fuel introduction chamber 4 and the pump receiving chamber 5A with each other is penetratingly formed in the bottom portion of the above-described first partitioning wall 3. Furthermore, an annular strainer F in the form of a mesh shape is arranged and fitted at a lower end of the first partitioning wall 3.

A fuel introduction passage 6 is opened to the fuel introduction chamber 4.

The above-described strainer F is located downstream of the opening of the first through-hole 3A, and a fuel introduction passage 6 is located downstream of the strainer F.

Reference numeral 7 denotes a second annular partitioning wall arranged and retained at a retainer stepped portion 2C in the intermediate portion of the upper box 2. By the partitioning wall, the upper box 2 is divided into a fuel discharge chamber 8 including the upper bottomed portion 2B and a pump receiving chamber 5B including the flanged portion 2A. A second through-hole 7A for communicating the pump receiving chamber 5B and the fuel discharge chamber 8 with each other is penetratingly formed in the second partitioning wall 7.

Then, a filter is disposed within the fuel chamber 8. In the embodiment, the filter 9 is cylindrical and a cylindrical filtration paper 9A is applied to wrap its outer periphery. At the same time, the filter 9 is pressingly arranged to the upper bottom portion 2B by a spring 10 compressed and arranged on the second partitioning wall 7. Also, reference numeral 11 denotes a fuel discharge passage opened toward the fuel discharge chamber 8. The fuel discharge passage 11 enters and opens in the interior of the cylindrical filtration paper 9A of the filter 9.

Reference character P denotes a fuel pump well known per se, that is composed of a motor portion M and a pump portion B. The fuel pump P is disposed within a pump chamber 5 which is composed of a pump receiving chamber 5A formed in the lower box 1 and a pump receiving chamber 5B formed in the upper box 2. In this embodiment, lower outer circumferential portion of the housing of the fuel pump P is inserted into and fixed to the cylindrical portion 3B formed to project upwardly from the body of the first partitioning wall 3. Then, an intake passage P1 is projected downwardly at the lower end of the fuel pump P, and a discharge passage P2 is projected upwardly at the upper end of the fuel pump P.

As described above, the lower box 1 and the upper box 2 are fixed together with the flanged portions 1A and 2A in contact with each other so that the hermetic pump chamber 5 is formed by the pump receiving chamber 5A including the flanged portion 1A of the above-described box 1 and the pump receiving chamber 5B including the flanged portion 2A of the upper box 2.

To sum up the foregoing, the fuel case A is formed by fixing the lower box 1 and the upper box 2 together with the flanged portions 1A and 2A in contact with each other, and the fuel introduction chamber 4, the pump chamber 5 and the fuel discharge chamber 8 are dividedly formed from one side C below the longitudinal axis X—X to the other side D above the longitudinal axis X—X within the fuel case A.

Then, the fuel introduction passage 6 is opened to the fuel introduction chamber 4.

The fuel pump P is arranged and received in the pump chamber 5. The intake passage P1 of the fuel pump P is opened into the fuel introduction chamber 4 through the first through-hole 3A and at the same time, the discharge passage P2 is opened into the fuel discharge chamber 8 through the second through-hole 7A.

Also, the filter is disposed within the fuel discharge chamber 8, and at the same time, the fuel discharge passage 11 is opened into the filter 9 of the fuel discharge chamber 8.

R denotes the fuel pressure control valve.

Reference numeral 12 denotes a diaphragm clamped between a housing 13 and a cover 14. The diaphragm 12 and the housing 13 constitute a fuel chamber 15. A spring chamber 16 is dividedly formed by the diaphragm 12 and the cover 14. Reference numeral 17 denotes a fuel introduction passage opened into the fuel chamber 15. This fuel introduction passage 17 is in communication with the fuel discharge chamber 8.

Also, reference numeral 18 denotes a fuel return passage opened into the fuel chamber 15, which may be opened and closed by a valve 19 formed integrally with the diaphragm 12.

Incidentally, reference numeral 20 denotes a spring compressed and arranged within the spring chamber 16 for pressing the diaphragm 12 toward the fuel chamber 15.

Accordingly, when any pressure is not present within the fuel chamber 15, the valve 19 is depressed by the spring 20 to close the fuel return passage 18.

Incidentally, reference numeral 30 denotes a vacuum pressure introduction passage for introducing the intake vacuum pressure within the intake pipe to be described later.

Then, the thus constructed fuel case A is mounted on a motorcycle as follows. This will now be described with reference to FIG. 2.

Reference character T denotes a fuel reservoir for reserving fuel within its interior. An engine E is arranged below the fuel reservoir T. Reference character J is a fuel injection valve clamped between a throttle body 21 and a fuel distributor pipe 22. The above-described throttle body is in communication with the engine E through an intake pipe 23. Then, in the fuel case A, the longitudinal axis A-X directing from one side C to the other side D is arranged substantially in the gravitational direction along the gravity direction. At this time, the fuel introduction chamber 4 is located downwardly in the gravity direction below the bottom surface T*a* of the fuel reservoir T.

Also, each flow of the fuel case A is coupled with other structures as described below. Namely, the fuel introduction passage 6 is in communication with the interior of the fuel reservoir through the bottom surface T*a* of the fuel tank T. The fuel return passage 18 is in communication with the fuel reservoir T. Also, the fuel discharge passage 11 is in communication with the fuel distributor pipe 22.

Incidentally, in order to arrange the above-described fuel case A substantially in the vertical direction, the fuel case A may be mounted to the throttle body 21 or the fuel tank T through a stay (not shown).

Also, the fuel return passage shown in FIG. 2 shows a modification of the fuel return passage 18 shown in FIG. 1 as described above. The explanation of the operation of the first embodiment will now be described with reference to the fuel return passage 18 shown in FIG. 1.

The operation will now be described.

The fuel within the fuel reservoir T is introduced into the fuel introduction chamber 4 through the fuel introduction passage 6 from the bottom surface T*a* of the fuel tank T due to the gravitational difference to fill the fuel introduction chamber 4.

Under such conditions, when the pump portion M of the fuel pump P is driven to rotate the pump portion B, the pump portion B sucks the fuel within the fuel introduction chamber 4, that has been subjected to the removal of foreign matter by the strainer 5, through the first through-hole 3A and the intake passage P1, and subsequently feeds to the fuel discharge chamber 8 the fuel that is pressurized through the discharge passage P2 and the second through-hole 7A.

The fuel that has been discharged to the fuel discharge chamber 8 is introduced into the fuel chamber 15 of the fuel pressure control valve R through the fuel introduction passage 17 to thereby push up the valve 19 through the diaphragm 12, to thereby balance between the force of the spring 20 and a predetermined fuel pressure, to thereby adjust the fuel pressure within the fuel discharge chamber 8 with the predetermined pressure.

In the release condition of the valve 19 upon the upward movement of the above-described valve 19, the fuel within the fuel chamber 15 is discharged into the fuel reservoir T through the fuel return passage 18.

With such an arrangement, the fuel pressure within the fuel discharge chamber 8 is adjusted to the predetermined pressure. The fuel adjusted in pressure is fed to the fuel distributor pipe 22 through the fuel discharge passage 11 and subsequently injected and fed to the throttle body 21 through the fuel injection valve J to reach the engine E.

In view of the case where the engine environment temperature remarkably increases in the normal travel after travelling at high speed for a long period of time, or in the hot restart, the fuel temperature within the fuel introduction chamber 4 remarkably increases by the increase in the engine environmental temperature so that bubbles are generated within the fuel introduction chamber 4.

Here, according to the present invention, due to the fact that the longitudinal axis X—X of the fuel case A composed of the fuel introduction chamber 4, the pump chamber 5 and the fuel discharge chamber 8 is arranged substantially in the vertical direction and the above-described fuel introduction chamber 4 is located at a lower portion of the bottom surface T*a* of the fuel reservoir T, the bubble generated in the fuel introduction chamber 4 is first discharged into the fuel discharge chamber 8.

Namely, this is due to the synergetic effect of the fact that the bubble generated within the fuel introduction chamber 4 moves by itself upwardly due to its own floating force to reach the fuel introduction chamber 4 and the fact that the intake passage P1 of the fuel pump P is opened into the fuel introduction chamber 4, the longitudinal axis of the fuel pump P is arranged also in the vertical direction, and the flow of the fuel in the fuel pump P upon the drive of the fuel pump P is directed in the vertical direction.

Subsequently, the bubble that has been introduced into the fuel discharge chamber 8 is smoothly discharged into the fuel reservoir T.

Namely, the bubble in the fuel discharge chamber 8 is discharged through the fuel discharge passage 11 or the fuel return passage 18. However, here, in view of the flow resistance of the bubble directed to the fuel discharge chamber 11 and the flow resistance of the bubble directed to the fuel return passage 18, the flow resistances are considerably different from each other.

Namely, the bubble directed to the fuel discharge passage 11 is subjected a large flow resistance by the cylindrical filtration paper 9A of the filter 9, whereas in the fuel return passage 18, the valve 19 is subjected the output pressure of the fuel pump 11 to release the fuel return passage 18 so that the flow resistance is low.

Accordingly, the bubble within the fuel discharge chamber 8 is discharged to the fuel return passage 18.

According to the above-described arrangement, the bubble generated in the fuel introduction chamber 4 is first discharged effectively to the fuel discharge chamber 8, and subsequently, effectively discharged from the fuel discharge chamber 8 through the fuel return passage 18 to the fuel reservoir T.

Accordingly, in the above-described normal traveling operation after traveling at high speed or the hot restart of the engine, it is possible to feed a desired amount of fuel without containing the bubble in a stable and continuous manner to the engine E through the fuel injection valve J. Thus, the above-described travelling operation may be performed in a good manner.

Incidentally, if the opening position of the fuel introduction passage 17 of the fuel pressure control valve R to the fuel discharge chamber 8 is located above, it is possible to further enhance the discharge property of the bubble toward the fuel return passage 18 from the fuel discharge chamber 8.

Also, in the pump receiving chamber 5, the longitudinal axis of the fuel pump P is disposed in the vertical direction as described above, whereby it is possible to effectively the discharge property of the bubble.

Also, as shown particularly in FIG. 2, if the fuel return passage 18A is in communication with the interior of the pump receiving chamber 5 of the fuel case A and then it is in communication with the fuel tank T again through the fuel return passage 18B from the pump receiving chamber 5, when the return fuel is circulated within the pump receiving chamber 5, it is possible to cool down the fuel pump P and to suppress the temperature elevation of the fuel pump P.

Also, the first partitioning wall 3 and the second partitioning wall 7 are provided in the fuel case A, the fuel introduction chamber 4, the pump chamber 5 and the fuel discharge chamber 8 may be dividedly formed so that the number of the parts of the structure for each chamber may be reduced to a minimum level and it is possible to enhance its productability.

Also, in the case where the maintenance for each chamber is to be performed, it is easy to perform the maintenance by removing the first partitioning wall 3 and the second partitioning wall 7.

Furthermore, the fuel pump P is mounted on the lower box 1 for forming the fuel case A through the cylindrical portion 3B of the first partitioning wall 3 whereby without using special members for supporting the fuel pump P, the fuel pump P may be inserted and fixed to cylindrical member 3B. This may reduce the manufacture cost.

As described above, according to the present invention, a fuel case has a fuel introduction chamber to which a fuel introduction passage is opened, a pump receiving chamber for receiving a fuel pump and a filter on a longitudinal axis X—X and further has a fuel discharge passage and a fuel discharge chamber to which the fuel introduction passage is opened, at the same time, the longitudinal axis X—X is arranged substantially in a substantially vertical direction and the fuel introduction chamber of the fuel case is disposed below a bottom surface of a fuel reservoir. Accordingly, even in the case where the environmental temperature of the engine increases that the bubble is introduced into the fuel introduction chamber, the bubble maybe discharged from the fuel discharge chamber to the fuel reservoir through the fuel introduction passage of the fuel pressure control valve and the fuel return passage. Accordingly, it is possible to feed the fuel that does not contain the bubble from the fuel discharge passage to the engine through the fuel injection valve whereby the normal travel drivability and the hot restart property of the engine after the high speed travel may be enhanced.

Also, since the fuel return passage is in communication with the fuel reservoir through the pump receiving chamber, the fuel pump disposed within the pump receiving chamber may be cooled down by the return fuel.

Also, the fuel introduction passage of said fuel pressure control valve is opened to a position above the fuel discharge chamber in the gravitational direction. It is therefore possible to further effectively perform the discharge function of the bubble from the fuel discharge chamber.

Also, the fuel case is formed by a lower box and an upper box, and the fuel case is dividedly formed into the fuel introduction chamber, the pump chamber and the fuel discharge chamber by a first partitioning wall formed on a retainer stepped portion of the lower box and a second partitioning wall formed on a retainer stepped portion of the upper box. It is therefore form each of the above-described chambers extremely easily in low cost.

Furthermore, a cylindrical portion extending upwardly along an inner side of the lower box is provided on said first partitioning wall, and the fuel pump is supported within the fuel case by said cylindrical portion. It is therefore possible to extremely easily form the fuel pump at low cost.

What is claimed is:

1. A fuel feed device in a motorcycle fuel injection system, for pressurizing fuel within a fuel tank and for injecting and feeding the pressurized fuel to an engine through a fuel injection valve mounted on a fuel distributor pipe, wherein:

in a fuel case comprising a lower box and a upper box, a fuel flow chamber, a pump receiving chamber and a fuel discharge chamber are formed along a longitudinal axis by a first partitioning wall and a second partitioning wall arranged inside of said fuel case;

a fuel introduction passage communicates with said fuel introduction chamber;

an intake passage of a fuel pump disposed within said pump receiving chamber communicates with said fuel introduction chamber, a discharge passage of said fuel pump communicates with said fuel discharge chamber, a filter is disposed in said fuel discharge chamber, and a discharge passage extends to the filter;

a fuel pressure control valve is divided into a spring chamber and a fuel chamber by a diaphragm clamped between a housing and a cover, a regulator fuel introduction passage and a fuel return passage communicate with the fuel chamber and the communication or connection of the fuel return passage to the fuel chamber is regulated by a valve moved in synchronism with the diaphragm;

the longitudinal axis of said fuel case is arranged substantially in a vertical direction and said fuel introduction chamber is located lower than a bottom of a fuel reservior; and said fuel introduction passage is in communication with said fuel reservoir, the fuel discharge passage is in communication with a fuel distributor pipe, the regulator fuel introduction passage of said fuel pressure control valve is in communication with the fuel discharge chamber, and the fuel return passage is in communication with the fuel reservoir.

2. The fuel feed device in a motorcycle fuel injection device, according to claim 1, wherein a downstream side of said return passage of said fuel pressure control valve is in communication with the fuel reservoir through the pump receiving chamber.

3. The fuel feed device in a motorcycle fuel injection device, according to claim 1, wherein an upstream side of the regulator fuel introduction passage of said fuel pressure control valve is connected to a position above or higher than the fuel discharge chamber in the vertical direction.

4. The fuel feed device in a motorcycle fuel injection device, according to claim 1, wherein said lower box of said fuel case is provided with a bottom wall or panel and wherein said upper box is provided with an upper wall or panel, said first partitioning wall being formed on a retainer stepped portion of the lower box and said second partitioning wall being formed on a retainer stepped portion of the upper box.

5. The fuel feed device in a motorcycle fuel injection device, according to claim 1, wherein a cylindrical portion extending upwardly along an inner side of the lower box is provided on said first partitioning wall, and the circumference of said fuel pump is supported within said fuel case by said cylindrical portion.

* * * * *